US006616086B2

(12) United States Patent
Nakamura et al.

(10) Patent No.: US 6,616,086 B2
(45) Date of Patent: Sep. 9, 2003

(54) WEB INFEED FOR A ROTARY PRINTING PRESS

(75) Inventors: Daisuke Nakamura, Kanagawa (JP); Yukio Ogawa, Kanagawa (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 10/096,586

(22) Filed: Mar. 14, 2002

(65) Prior Publication Data

US 2002/0130214 A1 Sep. 19, 2002

(30) Foreign Application Priority Data

Mar. 15, 2001 (JP) ..... P2001-073881

(51) Int. Cl.[7] ..... B65H 16/06; B65H 19/12; B65H 19/18

(52) U.S. Cl. ..... 242/559.2; 242/563; 242/596.5

(58) Field of Search ..... 242/559.2, 559, 242/563, 596.4–596.6

(56) References Cited

U.S. PATENT DOCUMENTS 2,075,192 A * 3/1937 George ..... 242/422.9
4,801,109 A * 1/1989 Hatakeyama et al. .... 242/571.3
4,821,974 A * 4/1989 Poehlein ..... 242/596.4
4,867,389 A * 9/1989 Scheuter ..... 242/534
4,903,910 A * 2/1990 Tamura ..... 242/558
6,328,249 B1 * 12/2001 Ogawa et al. ..... 242/559.2
6,491,252 B2 * 12/2002 Komatsu et al. ..... 242/596.1

FOREIGN PATENT DOCUMENTS

JP P3041619 3/2000
JP 2000-103553 4/2000
JP 2000103553 A * 4/2000 ..... B65H/19/30

* cited by examiner

*Primary Examiner*—Kathy Matecki
*Assistant Examiner*—Sang Kim
(74) *Attorney, Agent, or Firm*—Rader, Fishman & Grauer PLLC

(57) ABSTRACT

A rotary beam has mounted thereon a pair of carrier arms for rotatably supporting a roll of web from which the web is fed into the press, and another such arm pair for supporting another such web roll to which the web is to be spliced upon consumption of the first web roll. One of each pair of carrier arms has rotatably mounted thereto a hollow spindle to be partly inserted in the tubular core of the web roll. The hollow spindle has detents arranged at circumferential spacings thereon for fluid pressure actuation into frictional engagement with the inside surface of the web roll core. The other of each carrier arm pair has a second spindle rotatably mounted thereto which is to be held endwise against the web roll core via a spring-loaded end cap. How hard the web roll core is urged against the first spindle by the second spindle, resisting the unwinding of the web therefrom, depends upon whether the second spindle is held fast against the end cap or spaced therefrom by the spring. The second spindle is sprung away from the end cap upon decrease of the web roll diameter to a predefined limit, in order to mitigate tension on the web being paid out.

4 Claims, 9 Drawing Sheets

WEB INFEED FOR A ROTARY PRINTING PRESS

BACKGROUND OF THE INVENTION

1. Field of the Invention

This invention relates to web-fed rotary printing presses in general and, in particular, to a mechanism incorporated with such a press for infeeding a web of paper into the machine from successive web rolls as the web is spliced from one such roll to the next.

2. Description of the Prior Art

A familiar type of web infeed for a rotary printing press has two pairs of web roll carrier arms extending in opposite directions from a rotary arm carrier beam. Each pair of carrier arms rotatably carry a roll of paper web therebetween by engaging the opposite ends of the tubular core of the web roll. Held in a prescribed angular position about the axis of the carrier beam, the web roll on one pair of carrier arms first pays out its web to feed the press. When this web roll is nearly used up, the carrier beam is turned 90 degrees for splicing the web to the next web roll on the second pair of carrier arms. The carrier beam is turned another 90 degrees upon completion of web splicing, thereby bringing the second web roll to the payout position.

A variety of suggestions have been made for rotatably supporting a web roll between each pair of carrier arms. Japanese Patent No. 3,041,619 and Japanese Unexamined Patent Publication No. 2000-103553 are hereby cited as bearing particular pertinence to the instant invention. The former teaches use of hollow spindles rotatably mounted one to each carrier arm in axial alignment with each other so as to be loosely received in the opposite ends of the hollow core of a web roll. The hollow spindles on each pair of carrier arms are of like construction, each having a plurality of web roll core detents which are mounted at constant circumferential spacings thereon. All these detents are capable of fluid pressure actuation for displacement radially outwardly of the spindle into and out of frictional contact with the inside surface of the web roll core. After the web has been used up and spliced to the next roll, the web roll core is removed from between the pair of carrier arms by retracting the detents into the spindles.

An objection to this Japanese patent is an unnecessarily great dimension of the web infeed axially of the carrier beam, or transversely of the web being into the press. This inconvenience arises in part from the fact that both cylinders on each pair of carrier arms are equipped for fluid pressure actuation of the detents radially of each spindle. Additionally, the dimension in question must be made even longer because both spindles on each pair of carrier arms must travel axially into and out of the web roll core.

According to Japanese Unexamined Patent Publication No. 2000-103553, supra, each pair of carrier arms have different spindle means mounted respectively thereto. When a spindle on one carrier arm is pushed into one end of a web roll core, the other end of this core pushes in turn a tapering, spring-loaded end cap on one end of a spindle on the other carrier arm. By reaction, then, the tapering end cap is sprung back against the web roll core thereby forcing the same into axial alignment with the spindle. Detents on this spindle are also pushed by the web roll core and, by being done so, displaced radially outwardly into frictional engagement with the inside surface of the core.

This second reference additionally differs from the first in having means for forced removal of the core after consumption of all the web thereon. Such means include a set of fluid-actuated pushpins built into the spindle on each carrier arm. The pushpins on actuation cause retraction of the detents radially inwardly of the spindle out of engagement with the web roll core.

Although it possesses some advantages over the first cited reference, this second one has some shortcomings that are in urgent need of improvement. The detents on each spindle must move into frictional engagement with the inside surface of the web roll core as the spindle is forcibly inserted therein with the detents in abutment against one end of the core. This requires exertion of strong axial forces on the web roll core from its opposite ends, with the result that the spindles on each pair of carrier arms receive from the core just as strong reactive forces axially thereof. So stressed, the spindles offer correspondingly greater resistance to the rotation of the web roll and impart higher tension to the web being pulled into the press from the web roll. The web tension builds up, moreover, in inverse proportion to the diameter of the web roll. What is worse, the web must be spliced to the next roll when the web roll diameter is reduced nearly to a minimum. In the worst case, therefore, the web was broken by the forces applied thereto during splicing.

Another problem is, again, the inconveniently long dimension of this web infeed transversely of the web. One reason for this is that the fluid actuators for core removal are built into the spindles. Another reason is that the pair of spindles must both be driven into and out of the opposite ends of the web roll core.

SUMMARY OF THE INVENTION

An object of the present invention is to make the web infeed of the type under consideration more compact in construction than heretofore known in the art.

Another object of the invention is to cause the web of paper to be fed under proper tension in the face of a decreasing diameter of the web roll and hence to assure web splicing without the risk of web breakage.

Briefly, the present invention may be summarized as a web infeed for a rotary printing press, wherein a web of paper being fed into the press from a first roll of such web is spliced to a second web roll when the first web roll is used up. The web infeed comprises a carrier beam mounted to frame means for rotation about a longitudinal axis, and at least two pairs of carrier arms mounted to the carrier beam each for rotatably supporting a web roll therebetween. One of each pair of carrier arms has first spindle means and core removal means mounted thereto. The first spindle means comprises a first spindle which is rotatable relative to said one carrier arm about an axis parallel to the axis of rotation of the carrier beam and which is to be inserted in the hollow core of a web roll from one end thereof in centering engagement therewith, a plurality of detents movably mounted to the first spindle at circumferential spacings thereon and constrained to displacement radially of the first spindle, and fluid pressure actuation means built into the first spindle for moving the detents radially thereof into and out of frictional engagement with the inside surface of the web roll core when the first spindle is inserted therein. For forcibly removing the web roll core from the first spindle means following the consumption of the web that has been rolled thereon, the core removal means comprises fluid-actuated plunger means movable relative to said one carrier arm in a direction parallel to the axis of the first spindle of the first spindle means into abutment against the web roll core for pushing the same out of engagement with the first spindle means.

The other of each pair of carrier arms, on the other hand, has second spindle means mounted thereto in axial alignment with the first spindle means on said one of the same pair of carrier arms. The second spindle means comprises a second spindle rotatably mounted to said other carrier arm, and an end cap mounted to one end of the second spindle in axial alignment therewith for centering abutment against another end of the web roll core. The end cap is coupled to the second spindle so as to be free to travel a prescribed distance into and out of abutment against the second spindle and normally held a prescribed distance away therefrom under the bias of resilient means.

The web infeed according to the invention further comprises drive means for moving the second spindle means on said other of each pair of carrier arms the prescribed distance toward and away from the first spindle means on said one of the same pair of carrier arms. In one embodiment of the invention the drive means acts between the carrier beam and said other carrier arm for moving the latter with the second spindle means thereon toward and away from said one carrier arm. In another embodiment the drive means acts between said other carrier arm and the second spindle means for moving only the latter toward and away from the first spindle means on said one carrier arm.

Thus, where a web roll is mounted in position between either pair of carrier arms, the second spindle comes into abutment against the end cap in opposition to the force of the resilient means when moved by the drive means toward the first spindle. The second spindle is to be so held against the end cap until the web roll diameter dwindles to a prescribed limit toward the end of usage of all the web on that roll. As long as the second spindle is held fast against the end cap, the forces exerted axially on the web roll from both first and second spindle means are determined by the drive means.

After the web roll diameter drops past the prescribed limit, the second spindle may be permitted to travel away from the end cap under the force of the resilient means. Thereupon the axial forces on the web roll are determined by the resilient means, it being understood that the forces due to the resilient means are less than those imposed by the drive means. Thus, toward the end of web consumption, when an increasingly more unwinding force is needed in the tangential direction of the web roll, the axial forces thereon are reduced to lessen the tension on the web and hence virtually to eliminate the risk of web breakage during the ensuing course of web splicing.

The invention also teaches constant monitoring of the web roll diameter. The drive means is controlled automatically to permit the second spindle to be sprung out of abutment against the end cap upon reduction of the web roll diameter to the predetermined limit.

As a further advantage accruing from the above improved construction of the second spindle means, it is only the first spindle means that must be inserted to a certain depth into the web roll core. The dimension of this web infeed axially of the spindle means is therefore appreciably less than that according to the prior art. Additionally, no excessive forces are exerted axially on the web roll throughout the complete processes of its mounting, unwinding, and core removal, keeping the core from deformation or impairment.

It will also be appreciated that both the mounting of the web rolls between the pairs of carrier arms and the removal of the cores therefrom are mostly done from the side of the first spindle means only. The web infeed is therefore easy to inspect and maintain.

The above and other objects, features and advantages of this invention and the manner of realizing them will become more apparent, and the invention itself will best be understood, from a study of the following description and appended claims, with reference had to the attached drawings showing the preferred embodiments of the invention.

DESCRIPTION OF THE PREFERRED EMBODIMENTS

General

The representative web infeed for a rotary printing press, shown in its entirety in FIGS. 1 and 2, has a rotary carrier beam H of generally square cross section for carrying the various working parts and components of the web infeed to be set forth hereinbelow. Extending horizontally, the carrier beam H has its opposite ends rotatably journaled in a pair of confronting, upstanding framing walls T of the press. It is understood that a drive mechanism, not shown, of any known or suitable design is coupled to the carrier beam H for revolving the same. On each of a pair of opposite side surfaces of the carrier beam H there are formed a pair of guide rails J extending longitudinally of the beam. Two pairs of carrier arms 4 and 5 are mounted on the respective pairs of guide rails J via shoes 4*a* and 5*a* for sliding motion longitudinally of the carrier beam H.

Figure 1:
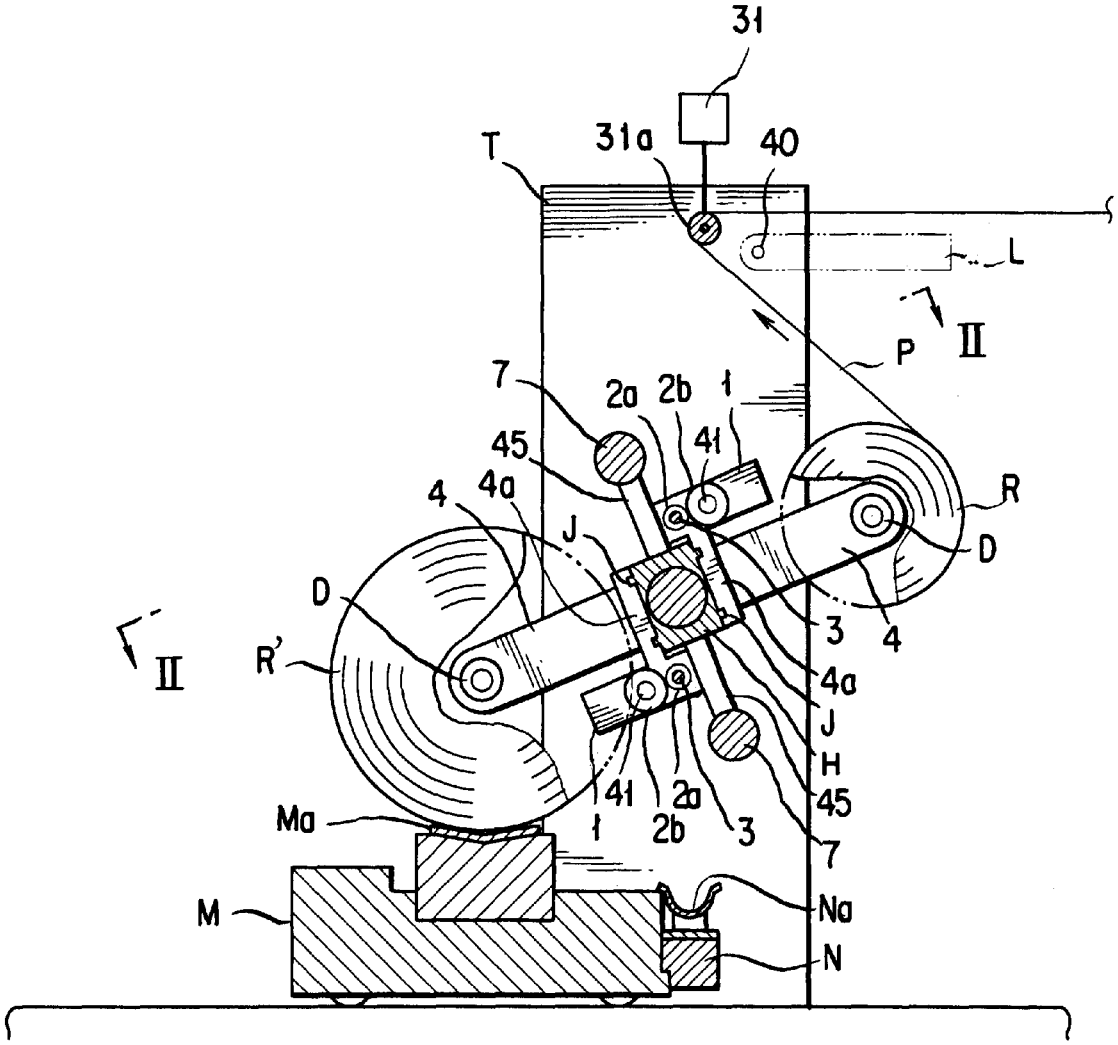
FIG. 1 shows, partly in vertical section and partly in elevation, the web infeed for a rotary printing press constructed according to the novel concepts of this invention.
Figure 2:
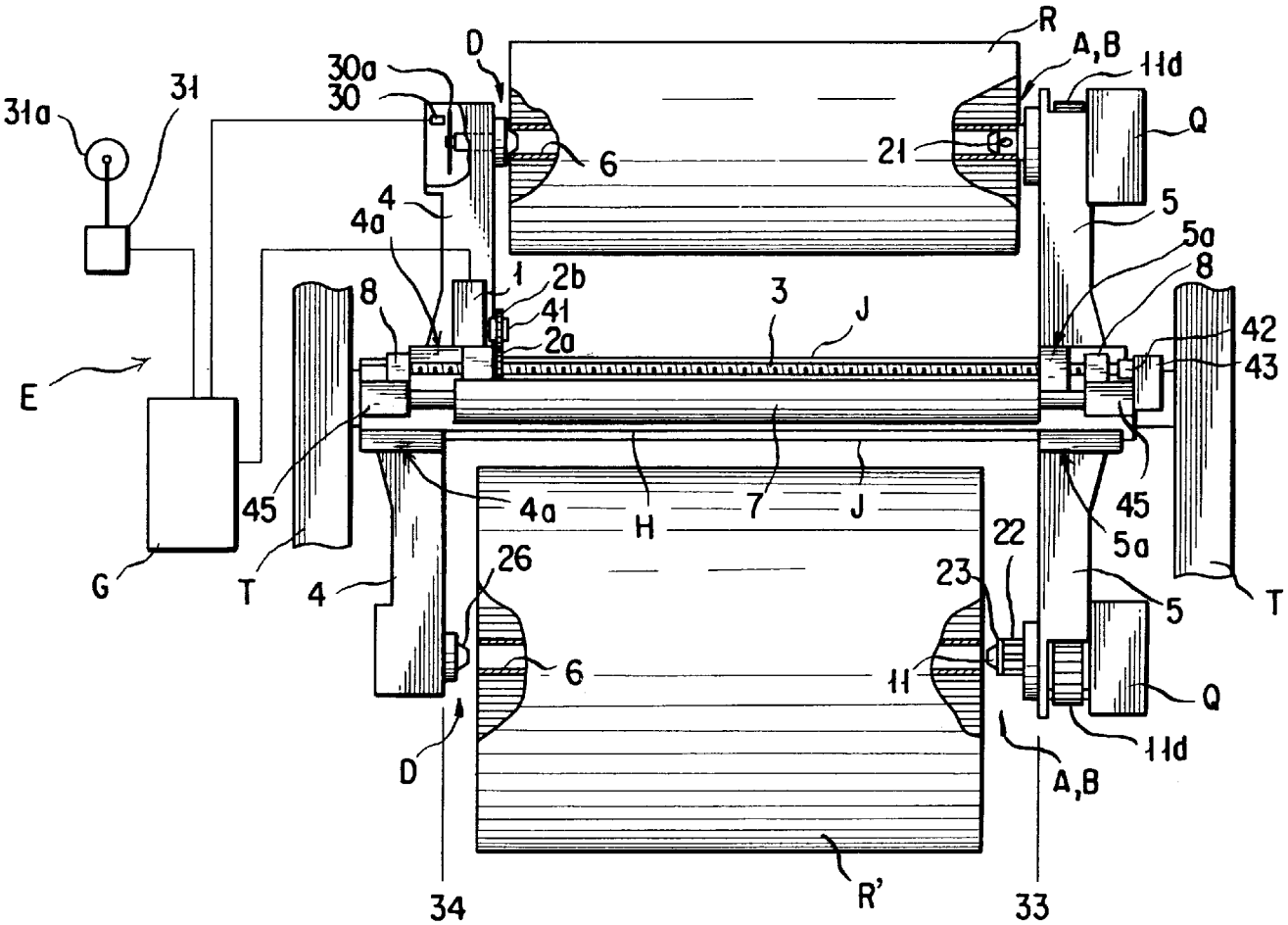
FIG. 2 is a section taken long the line II—II in FIG. 1, with parts shown broken away for clarity, the view also showing the electronic control system incorporated with the web infeed.

A closer inspection of FIGS. 1 and 2 will reveal that one roll R of paper web is supported between one pair of carrier arms 4 and 5, and another such web roll R' between the other pair of carrier arms 4 and 5. The web roll R is shown paying out the web of paper P into the printing station, not shown, of the press, and the other web roll R' shown standing by pending the complete consumption of the web roll R. Both web rolls R and R' are of standard make, each having a continuous web of paper wound on a tubular core 6.

For rotatably carrying the web rolls R and R' the two right-hand carrier arms 5, as seen in FIG. 2, have first spindle means A and web roll core removal means B mounted to their distal ends, away from the shoes 5*a,* whereas the left-hand carrier arms 4 have second spindle means D mounted to their distal ends. The first spindle means A and second spindle means D of each pair of carrier arms 4 and 5 differ in both construction and function, even though they cooperate to rotatably hold the web roll R or R' therebetween. The first spindle means A is capable of fluid pressure actuation for firm engagement and disengagement of the inside surface of the tubular core 6 of the web roll R or R' adjacent one end thereof, whereas the second spindle means D is designed to butt resiliently against the other end of the roll core. The first spindle means A and core removal means B, as well as fluid pressure actuation means C therefor, on one of the carrier arms 5 are illustrated on an enlarged scale in FIG. 3, and the second spindle means D on one of the carrier arms 4 in FIG. 4.

Figure 5:
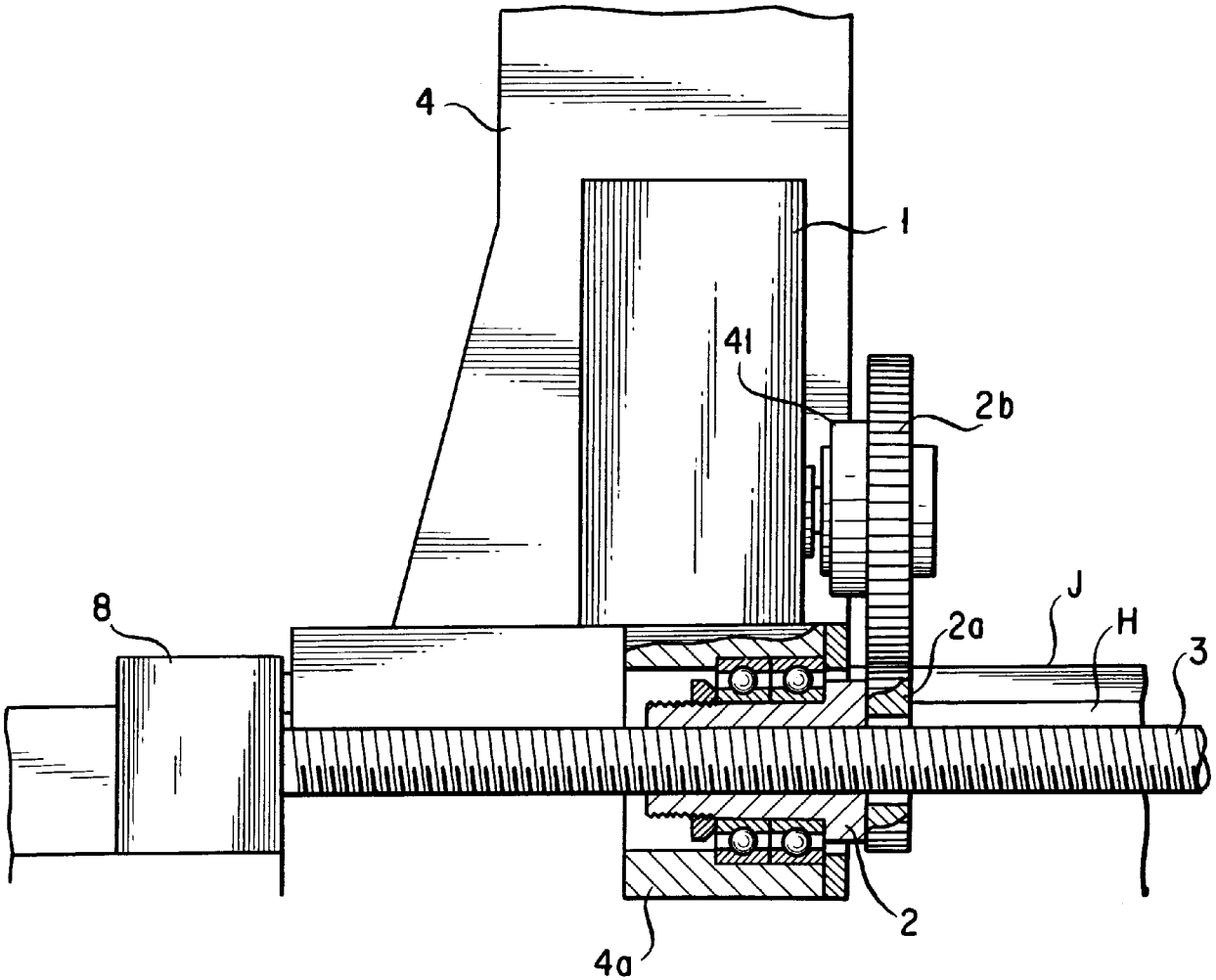
FIG. 5 is also an enlarged, fragmentary section through the web infeed, snowing in particular the means for moving the second spindle means of FIG. 4 toward and away from the first spindle means within limits.

Referring to FIGS. 1 and 2 again, each pair of carrier arms 4 and 5 are jointly to travel longitudinally of the carrier beam H together with the web roll R or R' rotatably supported therebetween for readjustment of the web roll positions in that direction. Furthermore, according to an operational feature of this invention, each left-hand carrier arm 4 is independently movable toward and away from one associated right-hand carrier arm 5 in this embodiment of the invention in order to move the second spindle means D thereon toward and away from the first spindle means A. FIG. 5 illustrates means for such independent travel of each left-hand carrier arm 4.

Two additional pairs of carrier arms 45 extend from the carrier beam H in opposite directions and at right angular relationship to the web roll carrier arms 4 and 5. Each such additional pair of arms 45 rotatably carry a web guide roller 7, extending parallel to the carrier beam H, for use in splicing the web P from the old roll R to the new R'. Another guide roller is provided at 31*a* between the pair of framing walls T for guiding the web P being unwound from the old roll R. A web splicer L is angularly displaceable about its axis 40.

At E in FIG. 2 is shown an electronic control system for automating this web infeed, particularly in regard to adjustment of the forces acting axially between the web roll R and the two spindle means A and D. FIG. 1 shows one such new web roll R' carried to a position under one pair of carrier arms 4 and 5 by a wheeled web roll carriage M, which preferably is self-propelled. This carriage M is formed to include a web roll rest $M_a$, on which the web roll R' is placed, and web roll core recovery means N having a core rest $N_a$ on which is to be deposited the web roll core 6 upon its removal from between either pair of carrier arms 4 and 5 after the web roll rest Ma of the web that has been wound thereon is used up. It is understood that the web roll carriage M is movable at least axially of the web roll R' mounted thereon, that is, in a direction normal to the drawing sheet of FIG. 1. Both roll rest $M_a$ and core rest $N_a$ are also understood to be movable up and down on the carriage M in order to expedite the loading of each new web roll R' between one pair of carrier arms 4 and 5 and the unloading of the web roll core 6 therefrom upon consumption of all the web that has been wound thereon.

Hereinafter in this specification the above noted pair of web roll carrier arms 4 and 5, first spindle means A, core removal means B, fluid pressure actuation means C, second spindle means D, and control system E will be explained in more detail, in that order and under separate headings. Operational description will follow the detailed explanation of the listed components.

Web Roll Carrier Arms

Employed for the desired travel of the web roll carrier arms longitudinally of the carrier beam H are two threaded rods 3, FIGS. 1 and 2, extending longitudinally of the carrier beam while being positioned somewhat spaced from its opposite side surfaces. Each threaded rod 3 is rotatably supported by and between a pair of bearing blocks 8 which are formed adjacent the opposite ends of the carrier beam H and which are so positioned as not to interfere with the travel of the carrier arm shoes 4*a* and 5*a*. Extending through one of the bearing blocks 8, each threaded rod 3 is coupled to a bidirectional electric drive motor 43 on the carrier beam H via a torque limiter 42. The right-hand carrier arms 5 have their shoes 5*a* screw-threadedly engaged with the respective threaded rods 3. The left-hand carrier arms 4 have their shoes 4*a* not directly engaged with the threaded rods 3, however.

FIG. 5 best illustrates how each left-hand carrier arm 4 is coupled to one threaded rod 3. Tubular in shape, the shoe 4*a* of the representative carrier arm 4 has concentrically mounted therein a sleeve 2 which is fitted over the threaded rod 3 in threaded engagement therewith. The sleeve 2 is rotatable relative to the carrier arm shoe 4*a* while being locked against axial displacement relative to the same. Coaxially secured to the sleeve 2 and loosely surrounding the threaded rod 3, a driven gear 2*a* meshes with a drive gear 2*b* to which is coupled a bidirectional electric drive motor 1 via a torque limiter 41. The drive motor 1 is mounted to the carrier arm shoe 4*a*.

Thus, upon rotation of each threaded rod 3 by one associated drive motor 43, FIG. 2, one associated pair of carrier arms 4 and 5 will travel jointly with their shoes 4*a* and 5*a* in sliding engagement with the rails J, in the same direction along the carrier beam H and with the spacing therebetween kept unchanged. When the pair of carrier arms 4 and 5 comes to a forced stop at either end of their stroke, the torque limiter 42 will function to permit the drive motor 43 to be set out of rotation upon lapse of a preassigned length of time. Each left-hand carrier arm 4 is additionally movable by its own drive motor 1 independently toward and away from the right-hand carrier arm 5. The rotation of the drive motor 1 will be imparted via the gears 2*a* and 2*b* to the internally threaded sleeve 2. Revolving in threaded engagement with the rod 3, the sleeve 2 will travel axially, and only this axial motion will be transmitted to the shoe 4*a* and thence to the carrier arm 4.

First Spindle Means

The first spindle means A, core removal means B, and fluid pressure actuation means C on the two carrier arms 5 are alike in construction. Only such means on one carrier arm 5 will therefore be described in detail, it being understood that the same description applies to the corresponding means on the other carrier arm 5.

Figure 3:
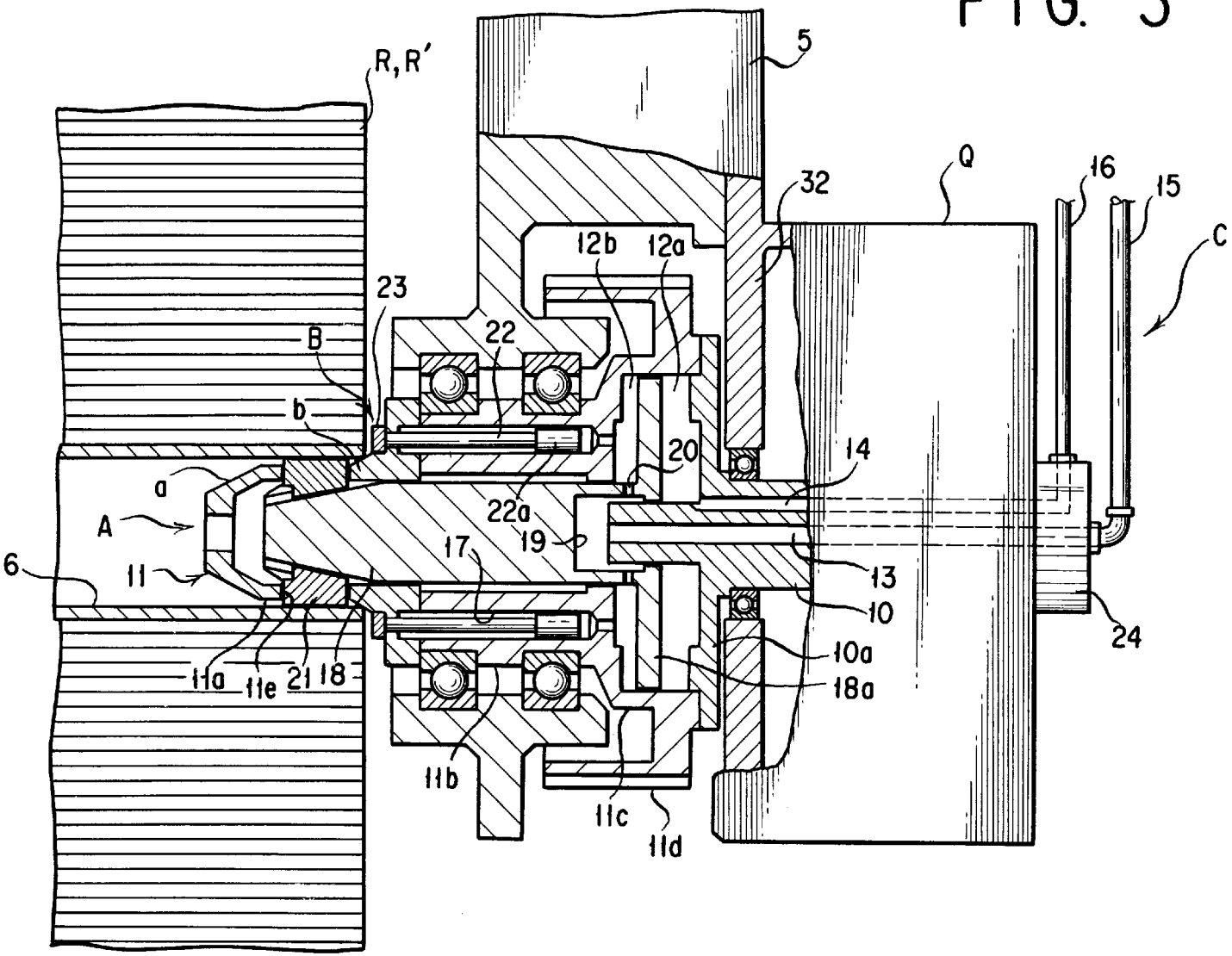
FIG. 3 is an enlarged, fragmentary section through the web infeed, showing in particular the first spindle means and the web roll core removal means on one of each pair of carrier arms.

With reference to FIG. 3 the representative first spindle means A illustrated therein includes a rotary, hollow spindle unit 11 substantially integrally comprising a small diameter front end portion 11*a,* shown directed to the left in this figure, an intermediate diameter mid-portion 11*b,* and a large diameter rear end portion 11*c,* all in axial alignment. The complete spindle unit 11 is rotatable relative to the carrier arm 5 as its mid-portion 11*b* is rotatably mounted thereto via bearings. Less in diameter than the inside diameter of the tubular core 6 of the web roll R or R', the front end portion 11*a* of the spindle unit 11 is wholly insertable, with its tapering nose a foremost, in the web roll core as depicted in this figure. The spindle unit mid-portion 11*b* is greater in diameter than the inside diameter of the web roll core 6, so much so that a tapering shoulder b between the spindle unit portions 11*a* and 11*b* is to butt against the end of the web roll core upon full insertion of the spindle unit front end portion therein. The spindle unit rear end portion 11*c* serves as the housing of a fluid actuated cylinder included in the fluid pressure actuation means C yet to be described.

The spindle unit 11 is provided as aforesaid with means for frictionally engaging the inside surface of the web roll core 6. Such means include a plurality of, four in this particular embodiment, detents or cam followers 21 seen in both FIGS. 3 and 6. The detents 21 are slidably received in respective slots 11*e* formed in the spindle unit front end portion 11*a* at constant circumferential spacings. Extending into the interior of the spindle unit front end portion 11*a,* the detents 21 have their inside ends slidably engaged with sloping, recessed cam surfaces of a piston rod 18 coaxially and slidably received in the spindle unit 11. This piston rod 18, forming a part of the fluid pressure actuation means C, is capable of fluid pressure actuation for moving the cam-following detents 21 into and out of frictional engagement with the inside surface of the web roll core 6, as will be later explained in more detail in connection with the fluid pressure actuation means C.

Core Removal Means

Figure 6:
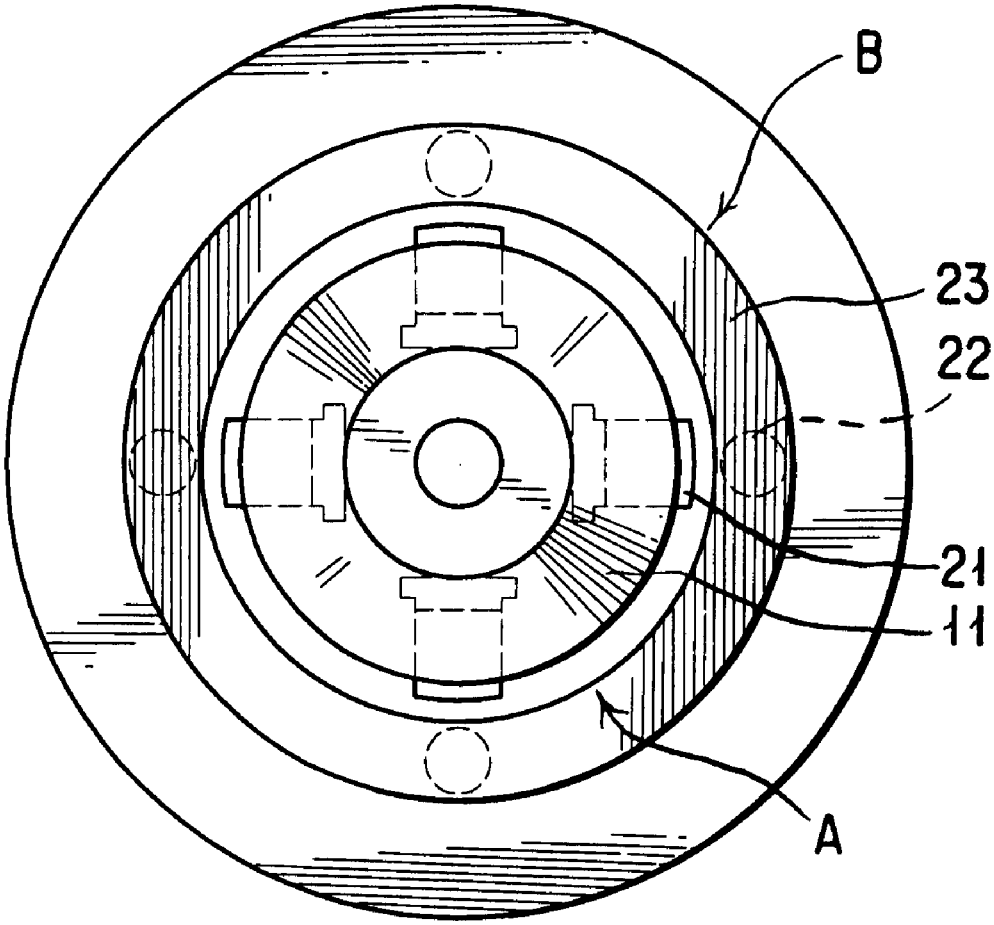
FIG. 6 is a still more enlarged end view of the first spindle means and web roll core removal means of FIG. 3, as seen from the left hand side of that figure.

As shown also in FIGS. 3 and 6, the web roll core removal means B includes a plurality of, four in this particular embodiment, plungers 22 which are coupled one to each of pistons 22*a* on one hand and, on the other hand, to a push ring 23. The pistons 22*a* are slidably received in respective bores 17 which are formed eccentrically in the spindle unit 11 and which extend parallel to its axis. Slidably extending through a non-tapering shoulder between the spindle unit front end portion 11*a* and mid-portion 11*b,* the plungers 22 are all coupled fast to the push ring 23.

FIG. 6 best indicates that the push ring 23 concentrically surrounds the spindle unit 11 and is sized to come into abutment against one end of the web roll core 6. Normally held retracted as pictured in both FIGS. 3 and 7, the push ring 23 is to be thrust forward by the plungers 22, as in FIG. 8, for pushing the web roll core 6 out of engagement with the spindle unit 11 upon full consumption of the web of paper thereon.

Fluid Pressure Actuation Means

With reference directed also to FIG. 3 the fluid pressure actuation means C includes the piston rod 18 slidably received in the front end portion 11*a* and mid-portion 11*b* of the spindle unit 11. The piston rod 18 is formed in one piece with a piston 18*a* slidably received in the spindle unit rear end portion 11*c*, pressure-tightly dividing its interior into a pair of opposed fluid chambers 12*a* and 12*b*. A bore 19 of cylindrical shape is cut coaxially in the piston 18*a* and in part of the piston rod 18 for slidably receiving an end portion of a shaft 10 rotatable with the spindle unit 11. The bore 19 communicates with the fluid chamber 12*b* via a plurality of radial passageways 20 and thence with the bores 17 receiving the pistons 22*a* of the web roll core removal means B.

Rotatably supported by a cover plate 32 affixed to the carrier arm 5, the shaft 10 is formed in one piece with a flange 10*a* which is secured to the spindle unit rear end portion 11*c* and which thus pressure-tightly closes the fluid chamber 12*a*. A fluid passageway 13 extends centrally through the shaft 10, and another fluid passageway 14 extends eccentrically therethrough. The first fluid passageway 13 is open at one end to the bore 19 in the piston rod 18, and the second fluid passageway 14 to the fluid chamber 12*a*. The other ends of the fluid passageways 13 and 14 are open to a rotary joint 24 and thereby held in constant communication with conduits 15 and 16, respectively, despite the rotation of the shaft 10. The conduits 15 and 16 are to be selectively placed as by a solenoid valve, not shown, in communication with a source, not shown, of pressurized fluid such as air and with a fluid vent.

Seen at Q in FIG. 3 is a brake box of one-piece construction with the said cover plate 32 on the carrier arm 5. The rotary shaft 10 has a brake disk, not shown, formed concentrically thereon and rotatably housed in the brake box Q. A brake shoe or shoes, also not shown, are also housed in the brake box Q for frictional engagement with the unshown brake disk, in order to brake the spindle unit 11, and therefore the web roll R or R', as the web is unwound therefrom by being pulled into the printing station of the press.

Second Spindle Means

Figure 4:
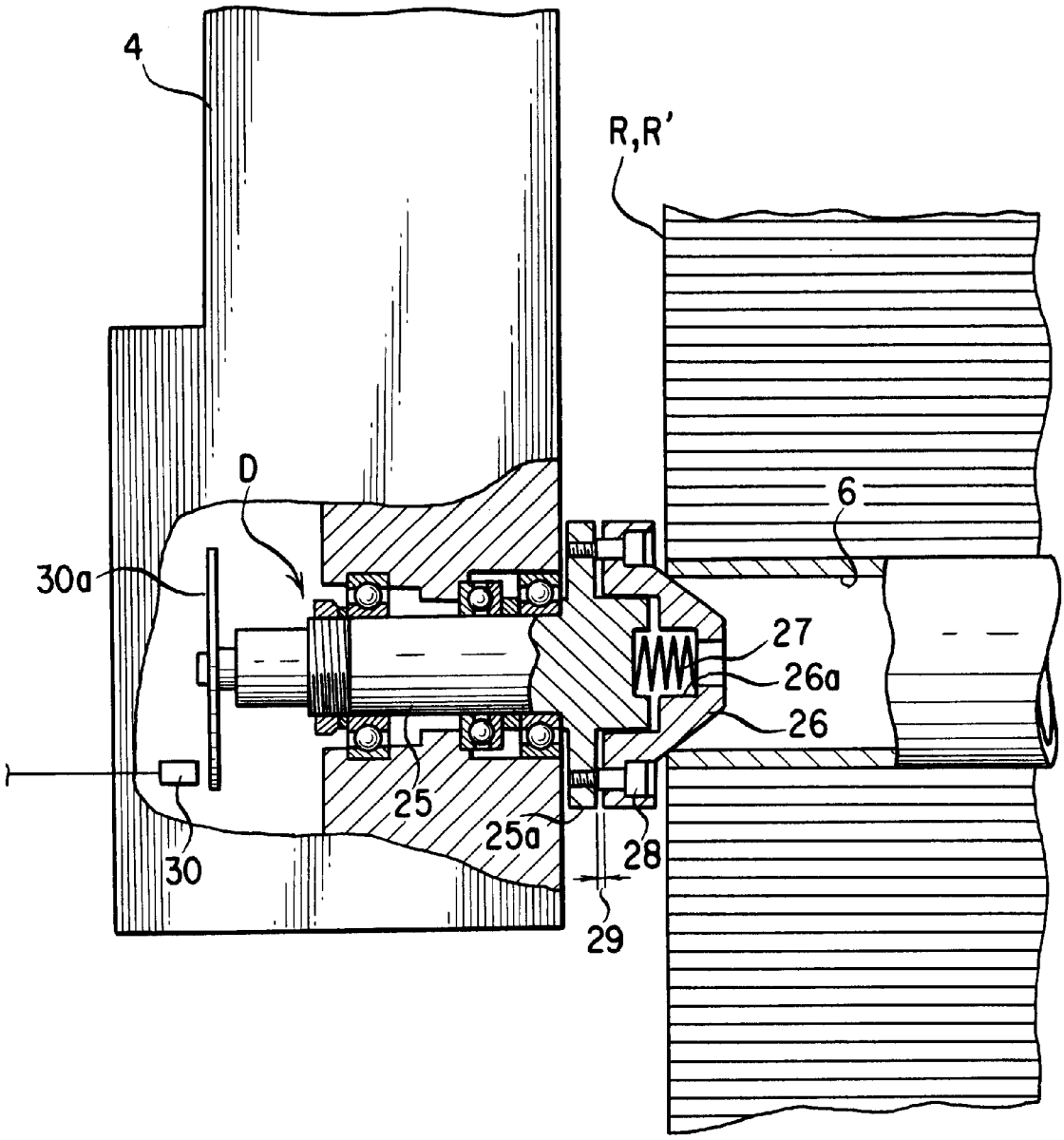
FIG. 4 is also an enlarged, fragmentary section through the web infeed, showing in particular, the second spindle means on the other of each pair of carrier arms.

Reference may be had to FIG. 4 for the following explanation of the representative second spindle means D on one carrier arm 4. The second spindle means D includes a solid spindle 25 rotatably mounted to the distal end of the carrier arm 4 in axial alignment to the hollow spindle unit 11 of the FIG. 3 first spindle means A. The spindle 25 is locked against axial displacement relative to the carrier arm 4. Enveloping the front end, shown directed to the right in FIG. 4, of the spindle 25, an end cap 26 is mounted thereto by being screwed at 28 to a collar 25*a* on the spindle. The end cap 26 is truncated conical in shape, tapering forwardly or toward the first spindle means A, with a diameter that is less at its front end, and greater at its rear end, than the inside diameter of the web roll core 6. Therefore, as depicted in FIG. 4, the end cap 26 is only partly received in the web roll core 6 and held against its end in line contact therewith in supporting the web roll R or R' in cooperation with the first spindle means A.

The confronting surfaces of the spindle 25 and the end cap 26 are recessed to provide a spring chamber 26*a* to accommodate a helical compression spring 27. This spring 27 is preloaded, normally providing a prescribed amount of clearance 29 between collar 25*a* of the spindle 25 and end cap 26. Consequently, depending upon the force exerted thereon from the web roll R or R', the end cap 26 is movable toward and away from the spindle 25 within the limits of the clearance 29, either against, or under, the bias of the preloaded compression spring 27. It is understood that the end cap 26 is key-jointed to the spindle 25 and thereby locked against relative rotary motion while being constrained to relative axial displacement.

Control System

The electronic control system for the web infeed appears in FIG. 2. Included are means for sensing the diameter of the web roll R or R' now in use. Such sensing means comprise a pulse generator 30 mounted to each left-hand carrier arm 4. As shown on an enlarged scale in FIG. 4, the pulse generator 30 is disposed opposite a rotary disk 30*a* mounted to the spindle 25 of the second spindle means D for generating a series of pulses at a repetition rate indicative of the speed of rotation of the web roll R or R' feeding the press. Another pulse generator 31, seen in both FIGS. 1 and 2, is coupled to the guide roller 31*a* for generating a series of pulses indicative of the revolutions of the guide roller and hence the running length of the web P. A rotary encoder is a preferred example of the second pulse generator 31.

Both pulse generators 30 and 31 of the web roll diameter sensing means are electrically connected to an electronic control circuit G. This circuit has an output connected to the drive motor 1, FIG. 5, which is mounted to each carrier arm 4 for its travel toward and away from one associated carrier arm 5. The control circuit G is equipped to ascertain the web roll diameter by counting the pulses from the pulse generators 30 and 31.

Operation

The operation of the illustrated web infeed will be discussed in terms of how each web roll is mounted between one pair of carrier arms 4 and 5, how the decreasing diameter of the web roll in use is sensed for web splicing to the next roll, and how the core of the web roll that has been used up is removed from between the pair of carrier arm 4 and 5. Such discussion will be divided under subheadngs.

Mounting of a New Web Roll:

For mounting each new web roll R' between one pair of carrier arms 4 and 5, these carrier arms must first be spaced from each other a distance greater than the axial dimension of the web roll. FIG. 2 shows one right-hand carrier arm 5 in its normal position 33, and one associated left-hand carrier arm 4 in a position 34 most retracted away from the arm 5. Furthermore, as illustrated in FIG. 1, this pair of carrier arms 4 and 5 must be so angularly positioned about the axis of the carrier beam H as to receive therebetween the new web roll R' as the same is brought by the carriage M, resting on the roll rest $M_a$ thereon. This roll rest $M_a$ may be raised on the carriage M to bring the new web roll R' thereon into axial alignment with the first spindle means A and second spindle means D on the carrier arms 4 and 5.

Next comes a step of engaging the new web roll R' between the spindle means A and D on the pair of carrier arms 4 and 5. Toward this end the drive motor 1, FIG. 5, on the left-hand carrier arm 4 may be set into rotation, preferably automatically in response to the sensing of the new web roll R' that has been positioned above, by a web roll sensor, not shown. The drive motor 1 is to rotate at this time in a direction for moving the left-hand carrier arm 4 toward the right-hand one 5, until the truncated conical end cap 26, FIG. 4, of the second spindle means D becomes engaged in the ferrule, not shown, of annular shape on one end of the web roll core 6.

The roll rest Ma of the web roll carriage M is movable as aforesaid axially of the web roll R' positioned thereon. Therefore, pushed by the left-hand carrier arm 4, the new web roll R' will travel toward the right-hand one 5 together with the roll rest Ma. It is understood that the right-hand carrier arm 5 is now in its normal position 33, with the detents 21 of the first spindle means A thereon retracted into the hollow spindle unit 11, and with the plungers 22 of the core removal means B projecting from the spindle unit bores 17 to hold the push ring 23 thrust out. These states of the first spindle means A and the core removal means B, which are both reflected in FIG. 8, have been brought about upon removal of the core 6 of the previously used web roll from between the pair of carrier arms 4 and 5, as will be set forth in more detail in the following.

Figure 7:
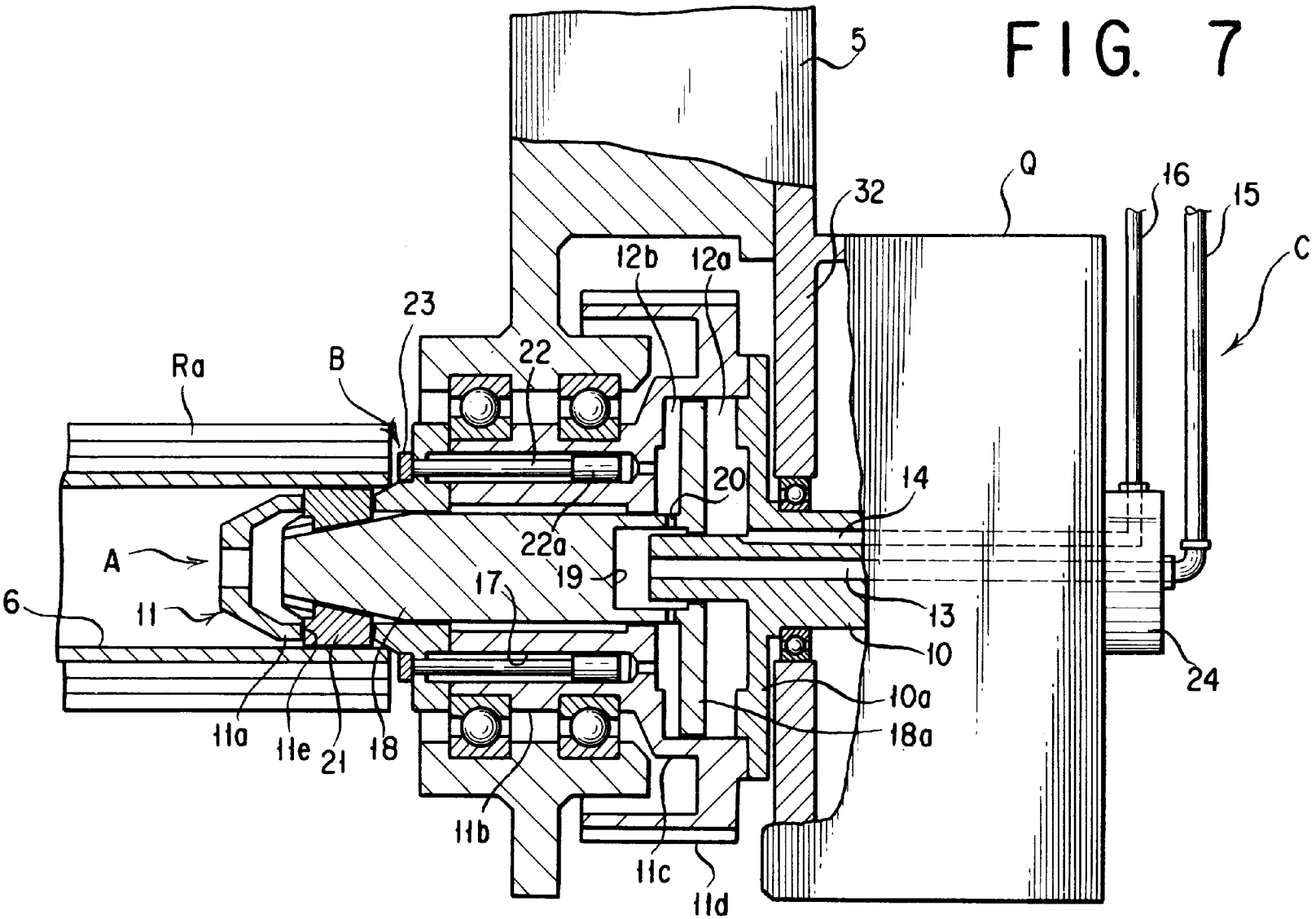
FIG. 7 is a view somewhat similar to FIG. 3 but explanatory of the operation of the web roll core removal means, which is herein shown retracted.

As best depicted in FIG. 7, the detents 21 of the first spindle means A have been pressed against the inside surface of the web roll core 6 by the piston rod 18 in its most advanced position until all the web roll thereon is consumed. Upon subsequent completion of web splicing from this web roll to the next, the unshown solenoid valve on the conduits 15 and 16, FIG. 3, is actuated to place the conduit 15 in communication with the unshown source of air under pressure, and to vent the other conduit 16. The pressurized air will flow into the bore 19 in the piston rod 18 from the passageway 13 in the shaft 10 and thence into the air chamber 12*b* through the radial passageways 20 in the piston rod 18. Since the other air chamber 12*a,* on the other side of the piston 18*a,* is now open to the atmosphere through the passageway 14 in the shaft 10 and through the conduit 16, this piston will travel to the right from its FIG. 7 position to that of FIG. 8. Thereupon the detents 21 will be free to travel down the taping cam surface of the piston rod 18 and hence to release the core 6 of the web roll that has been used up.

Figure 8:
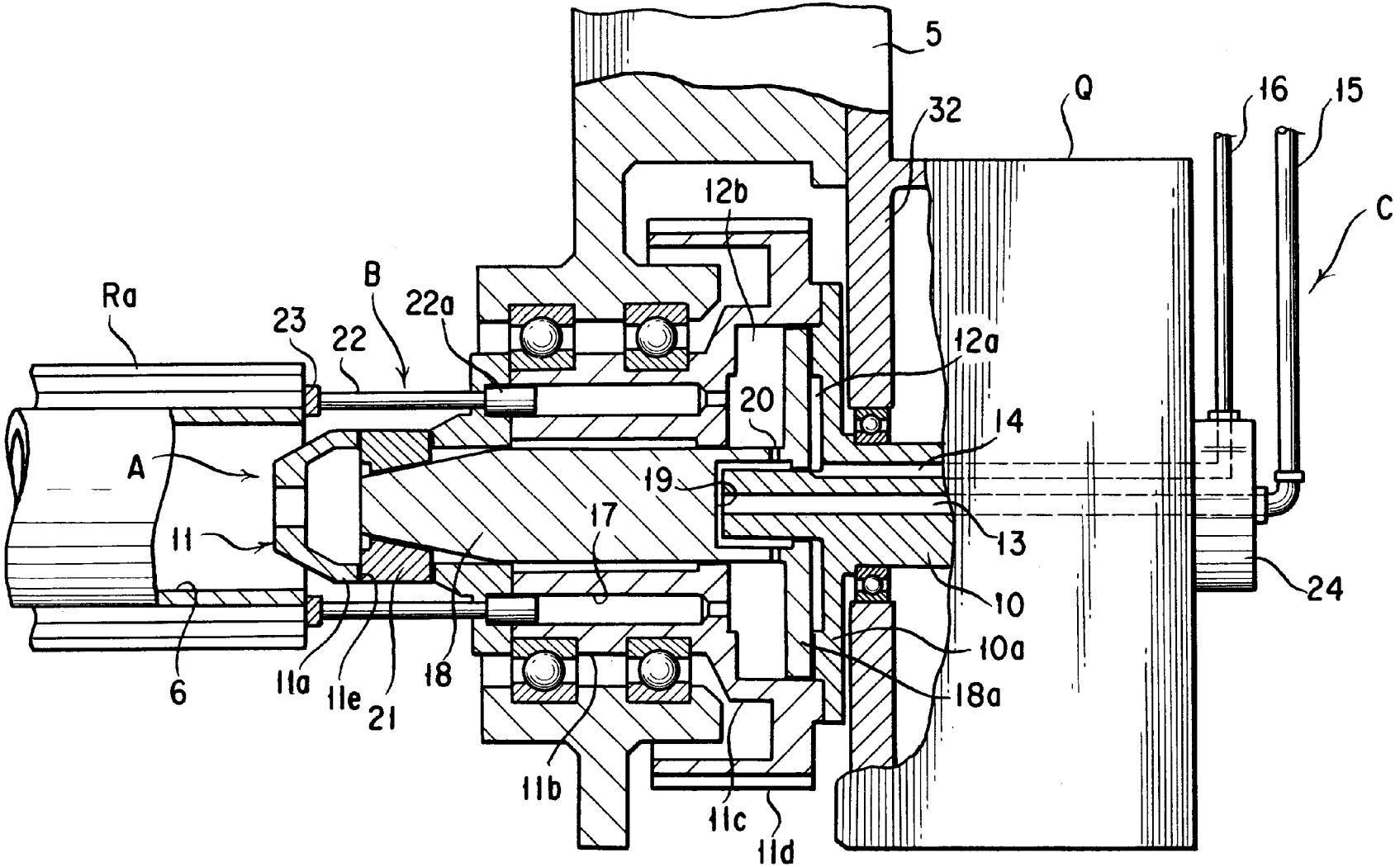
FIG. 8 is a view similar to FIG. 7 but showing the web roll core removal means operating to remove the web roll core from the first spindle means after the web has been used up.

The pressurized air that has entered the air chamber 12*b* as above will thence flow into the bores 17 and act on the pistons 22*a,* causing the piston rods 22 to extend from their FIG. 7 position to that of FIG. 8. Butting against the end of the web roll core 6, the push ring 23 on the piston rods 22 will push the core out of the spindle unit 11. The web roll core 6 is now withdrawable from between the pair of carrier arms 4 and 5. The unshown solenoid valve on the conduits 15 and 16 is reactuated to place both conduits in communication with the atmosphere following the withdrawal of the web roll core 6 from between the pair of carrier arms 4 and 5.

The foregoing will have made clear how the first spindle means A and core removal means B obtained the FIG. 8 upon unloading of the core 6 of the previously used web roll from between the pair of carrier arms 4 and 5. It has been stated that, pushed by the left-hand carrier arm 4, the new web roll R' on the roll rest Ma travels therewith toward the right-hand carrier arm 5. The new web roll R' on coming into abutment against the push ring 23 will readily push the plungers 22 into the bores 17 because the conduits 15 and 16 are now both open to the atmosphere. The new web roll R' will continue traveling toward the right-hand carrier arm 5, receiving the hollow spindle unit 11 therein, until the ferruled end of its core come into abutment against the tapering shoulder b of the spindle unit as in FIGS. 3 and 7.

Then, in order to engage the core 6 of the new web roll R' by the detents 21, the unshown solenoid valve is actuated again to place the conduit 16 in communication with the pressurized air source, and to leave the other conduit 15 open to the atmosphere. The pressurized air will enter the air chamber 12*a* through the passageway 14 in the shaft 10 and act on the piston 18*a* to cause extension of the piston rod 18 from its FIG. 8 position to that of FIG. 3 or 7. Thereupon the detents 21 will relatively slide up the sloping cam guideways on the piston rod 18 thereby projecting radially outwardly of the spindle unit front end portion 11*a* into frictional engagement with the inside surface of the core 6 of the new web roll R'.

The left-hand carrier arm 4 is to continue traveling after the core of the new web roll R' has come into abutment against the tapering shoulder b of the spindle unit 11 as above. Such continued travel of the left-hand carrier arm 4 is possible because, as clearly seen in FIG. 4, the end cap 26 of the second spindle means D has been held the prescribed distance 29 away from the spindle 25 by the preloaded compression spring 27. The spindle 25 will hit the end cap 26 at the end of its travel over the distance 29 with the left-hand carrier arm 4, whereupon the torque limiter 41, FIG. 6, will function to allow the drive motor 1 to be set out of rotation upon lapse of a preassigned length of time. The extent to which the left-hand carrier arm 4 pushes the new web roll R' toward the right-hand carrier arm 5 depends upon the maximum motor output torque that is transmitted through the torque limiter 41.

Now the new web roll R' has been rotatably supported by and between the first spindle means A and second spindle means D. The web roll rest Ma of the carriage M may be caused to descend, and the carriage M to travel away from the web infeed.

Sensing of the Web Roll Diameter:

The web roll R from which the web is being fed into the printing station of the press is angularly positioned as indicated in FIG. 1 about the axis of the carrier beam H. The web P is unwound from this roll R by being pulled by the printing cylinders of the printing station. Paying out the web P, the web roll R will rotate with the hollow spindle unit 11 of the first spindle means A and the spindle 25 of the second spindle means D relative to one associated pair of carrier arms 4 and 5, while being braked by the unshown means within the brake box Q.

The decreasing diameter of the web roll R is constantly monitored during the progress of web infeeding therefrom. The web roll diameter is ascertained by counting the pulses that are generated with a repetition frequency proportional to the running length of the web P, per revolution of the web roll R. The pulse generator 30, FIGS. 2 and 4, is designed to provide the web roll revolution pulses, putting out one such pulse for each complete revolution of the spindle 25, whilst the pulse generator 31, FIGS. 1 and 2 is intended to provide the web running length pulses. The web P is fed at a constant speed into the printing station throughout its length. Consequently, the web running length pulses will remain the same in frequency, but the web roll revolution pulses will grow higher in frequency with a decrease in web roll diameter. It is thus seen that less and less web running length pulses will be counted for each web roll revolution pulse with a decrease in web roll diameter.

When the web roll R is consumed to a predefined diameter, as sensed by counting the web running length pulses for each web roll revolution pulse as above, the control circuit G will cause the drive motor 1, FIG. 5, to move the left-hand carrier arm 4 away from the right-hand carrier arm 5 a distance somewhat less than the preassigned spacing 29, FIG. 4, between collar 25*a* of the spindle 25 and end cap 26.

As has been stated, the left-hand carrier arm 4 has so far been pushing the web roll R against the right-hand carrier arm 5 with a force corresponding to the maximum torque transmitted through the torque limiter 41, with the spindle 25 held fast against the end cap 26. With the noted slight backing of the left-hand carrier arm 4, however, it is now the force of the compression spring 27, not the preset maximum torque of the torque limiter 41, with which the web roll R is urged against the right-hand carrier arm 5 via the first spindle means A. This spring force must be less than that determined by the maximum torque setting of the torque limiter 41 and greater than the force exerted axially on the second spindle means D by the weight of the web roll R' after it has been consumed to the predefined diameter.

Removal of the Web Roll Core from Between the Carrier Arms:

As is conventional in the art, the carrier beam H is to be automatically turned approximately 90 degrees in a clockwise direction, as viewed in FIG. 1, upon consumption of the web roll R to a prescribed diameter. The web P that has been unwound from this web roll R will then be severed therefrom and spliced by the splicer L to the new web roll R' which has been kept standing by on the other pair of carrier arms 4 and 5. It is also the usual practice in the art to impart rotation to the new web roll R' before the web P from the old web roll R is spliced, by means of a predrive, not shown, coupled to the driven gear 11*d,* FIG. 3, on the spindle unit 11 of the first spindle means A. The web P is spliced to the new web roll R' being driven at the same peripheral speed as the running speed of the web.

The carrier beam H is to be turned another 90 degrees in the same direction as before, upon completion of web splicing. Thus brought to the position that has been occupied by the old web roll R as in FIG. 1, the new web roll R' will thereafter pay out the web for consumption by the press. The core 6 of the old web roll R, on the other hand, has been carried to the position where it is to be removed from between the pair of carrier arms 4 and 5 and deposited on the core rest $N_a$ on the carriage M. It is understood that this carriage M has already been positioned with its core rest $N_a$ right under the web roll core 6 being held by one pair of carrier arms 4 and 5, and that the core rest has been raised, ready to receive the core.

The removal of the web roll core 6 starts with the retraction of the left-hand carrier arm 4 away from the right-hand one 5. The tapering end cap 26, FIG. 4, on the spindle 25 of the second spindle means D will be withdrawn from the web roll core 6 with such travel of the left-hand carrier arm 4. The detents 21, FIG. 3, of the first spindle means A are still held fast against the inside surface of the web roll core 6 at this time. Therefore, no matter how hard the end cap 26 may have been embedded in the web roll core 6, the cap will readily disengage the core on backing away with the left-hand carrier arm 4. This retraction of this arm 4 is to come to a stop in the position 34, FIG. 2, farthest from the right-hand carrier arm 5. The web roll core 6 is now cantilevered by the first spindle means A.

For removal of the web roll core 6 from the first spindle means A, the unshown solenoid valve is actuated to place the air chamber 12*a,* FIG. 3, in communication with the air vent by way of the conduit 16, and the other air chamber 12*b* in communication with the pressurized air source by way of the conduit 15. The air pressure building up in the chamber 12*b* will cause contraction of the piston rod 18 and, in consequence, retraction of the detents 21 into the spindle unit 11 out of frictional engagement with the web roll core 6. The air that has been forced into the air chamber 12*b* as above will thence flow into the bores 17 thereby causing extension of the plungers 22 from their FIG. 3 position to that of FIG. 8. The plungers 22 will push the web roll core 6 endwise via the push ring 23.

Released from the detents 21 and pushed by the push ring 23, the web roll core 6 will come off the spindle unit 11 and fall onto the core rest $N_a$. The web roll core 6 will be recovered by the recovery means N as the core rest $N_a$ is lowered subsequently. Possibly, the web roll core 6 may not be wholly deposited on the core rest $N_a$ while the latter is raised, but may stand endwise thereon by having one end kept caught by the spindle unit 11. Thanks to the tapering nose of this spindle unit, however, the web roll core 6 will infallibly fall under its own weight onto the core rest $N_a$ upon subsequent descent of this core rest.

Alternate Embodiment

Figure 9:
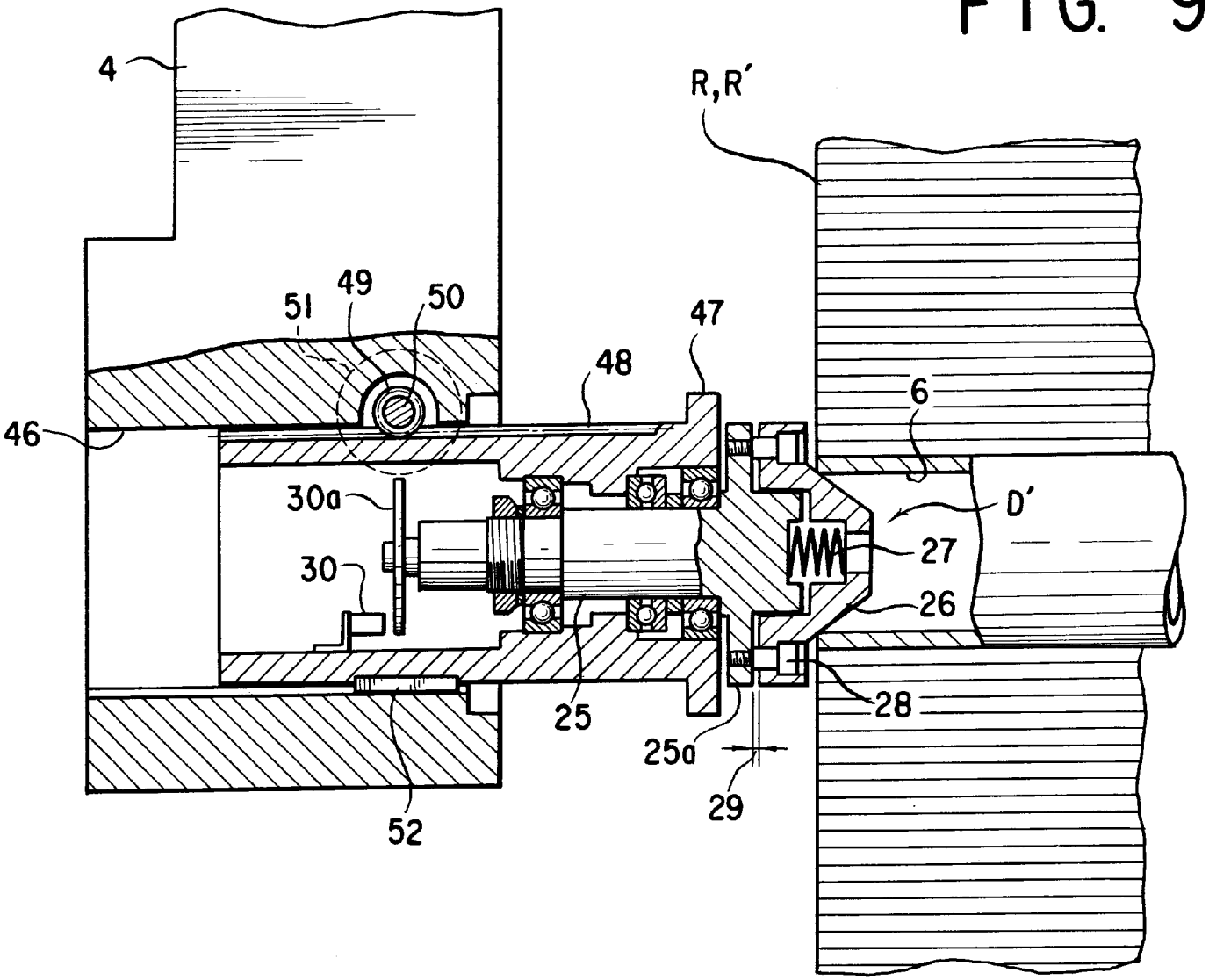
FIG. 9 is a view similar to FIG. 4 but showing alternative means for moving the second spindle means toward and away from the first spindle means within limits.

In the slight modification of the foregoing embodiment shown in FIG. 9, the second spindle means D' as a whole is made movable axially thereof relative to each left-hand carrier arm 4 toward and away from the first spindle means A on one associated right-hand carrier arm 5. This is in contrast to the preceding embodiment in which the second spindle means D as a whole is not axially displaceable relative to the carrier arm 4, as shown in FIG. 4, but in which the carrier arm 4 is itself movable with the second spindle means D toward and away from the right-hand carrier arm 5 as in FIG. 5. The modified second spindle means D' on the two left-hand carrier arms 4 are of like construction, so that only one such means D' on one carrier arm 4 will be described in detail with reference to FIG. 9.

The representative second spindle means D' is mounted to a sleeve 47 which is slidably received in a hole 46 cut in the left-hand carrier arm 4 in a direction parallel to the axis of its revolution. A key 52 locks the sleeve 47 against rotation relative to the carrier arm 4. Employed for the desired longitudinal displacement of the sleeve 47 relative to the carrier arm 4 is a rack-and-pinion mechanism comprising a rack 48 formed longitudinally on its surface of the sleeve 47, and a pinion 49 rotatably mounted to the carrier arm 4 for engagement with the rack 48. The pinion 49 is rotatable with a shaft 50 which is coupled via a torque limiter, not shown, to a drive motor 51 mounted to the carrier arm 4.

Itself similar in design to its FIG. 4 counterpart D, the second spindle means D' has the spindle 25 rotatably and coaxially mounted within the sleeve 47 and constrained to joint axial travel therewith by the rack-and-pinion mechanism. The end cap 26 is coupled by the screws 28 to the collar 25*a* on the spindle 25 and biased away therefrom by the preloaded compression spring 27, normally with the clearance 29 between collar 25*a* of the spindle 25 and end cap 26.

Operationally, this alternate embodiment differs from the first disclosed one only in that the second spindle means D' travels axially relative to the carrier arm 4, instead of traveling therewith, toward and away from the first spindle means A. The above described operation of the first embodiment largely applies to this second one, so that no repeated explanation of its operation is considered necessary.

Notwithstanding the foregoing detailed disclosure it is not desired that the present invention be limited by the exact details of the illustrated embodiments or by the description thereof; instead, the invention should be construed broadly and in a manner consistent with the fair meaning or proper scope of the subjoined claims.

What is claimed is:

1. A web infeed for a rotary printing press, wherein a web of paper being fed into the press from a first roll of such web is spliced to a second web roll when the first web roll is used up, each web roll being wound upon a hollow core, the web infeed comprising:

(A) a carrier beam mounted to frame means for rotation about an axis extending longitudinally thereof;

(B) at least two pairs of carrier arms mounted to the carrier beam each for rotatably supporting at least one web roll therebetween;

(C) first spindle means mounted to one of each pair of carrier arms, the first spindle means comprising:

(a) a first spindle rotatable relative to said one carrier arm about an axis parallel to the axis of rotation of the carrier beam, the first spindle having an end portion to be inserted in the hollow core of one of said web rolls from one end thereof, and a shoulder joined to the end portion for engaging said one end of the web roll core when the end portion of the first spindle is inserted therein;

(b) a plurality a detents movably mounted to the end portion of the first spindle at circumferential spacings and constrained to displacement radially of the first spindle; and (c) fluid pressure actuation means built into the first spindle for moving the detents radially thereof into and out of frictional engagement with the inside surface of the web roll core when the end portion of the first spindle is inserted therein;

(D) core removal means for forcibly removing the web roll core from the first spindle means following the consumption of the web that has been rolled thereon, the core removal means comprising:

(a) plunger means mounted to said one of each pair of carrier arms for movement in a direction parallel to the axis of a first spindle of the first spindle means; and (b) fluid pressure actuation means for moving the plunger means relative to said one carrier arm into and out of abutment against the web roll core, the plunger means on movement into abutment against the web roll core being capable of pushing the same out of engagement with the first spindle means;

(E) second spindle means mounted to the other of each pair of carrier arms in axial alignment with the first spindle means on said one of the same pair of carrier arms, the second spindle means comprising:

(a) a second spindle rotatable relative to said other of each pair of carrier arms about the same axis as the first spindle of the first spindle means;

(b) an end cap disposed on one end of the second spindle for centering abutment against another end of the web roll core;

(c) means coupling the end cap to the second spindle so as to permit the latter part of the end cap to travel a prescribed distance into and out of abutment against the former part of the second spindle; and (d) resilient means acting between the end cap and the second spindle for normally holding the latter part of the end cap the prescribed distance away from the former part of the second spindle; and (F) drive means for moving the second spindle means on said other of each pair of carrier arms the prescribed distance toward and away from the first spindle means on said one of the same pair of carrier arms;

(G) wherein the web roll between each pair of carrier arms is urged by the second spindle means against the first spindle means with a force determined by the drive means when the second spindle of the second spindle means is urged by the drive means against the end cap of the second spindle means in opposition to the force of the resilient means, and, when the second spindle is held away from the end cap under the force of the resilient means, with the force determined by the resilient means.

2. The web infeed of claim 1 further comprising:

(a) sensor means for sensing the diameter of the web roll on either pair of carrier arms from which the web is being fed into the press; and (b) control means for controllably actuating the drive means according to the diameter of the web roll sensed by the sensor means, the control means causing the drive means to hold the second spindle of the second spindle means against the end cap when the web roll diameter is above a prescribed limit, and to hold the second spindle away from the end cap when the web roll diameter drops to, and past, the prescribed limit.

3. The web infeed of claim 1 wherein the second spindle of the second spindle means is locked against axial displacement relative to said other of each pair of carrier arms, wherein said other of each pair of carrier arms is mounted to the carrier beam for movement toward and away from said one of the same pair of carrier arms, and wherein the drive means acts between the carrier beam and said other carrier arm for moving the latter part of the carrier arms with the second spindle means thereon.

4. The web infeed of claim 1 wherein the second spindle of the second spindle means is rotatably mounted to a sleeve which in turn is mounted to said other of each pair of carrier arms for movement axially of the second spindle, and wherein the drive means acts between said other carrier arm and the sleeve.

* * * * *